United States Patent [19]

Rumsey

[11] Patent Number: 4,706,426

[45] Date of Patent: Nov. 17, 1987

[54] FIRE-RATED FLUSH MOUNTED CORNER GUARD

[75] Inventor: Roger L. Rumsey, Wichita, Kans.

[73] Assignee: Balco, Inc., Wichita, Kans.

[21] Appl. No.: 935,797

[22] Filed: Nov. 28, 1986

[51] Int. Cl.[4] ..... E04F 13/06; E04F 19/02

[52] U.S. Cl. ..... 52/232; 52/255; 52/288

[58] Field of Search ..... 52/288, 232, 254, 255, 52/467

[56] References Cited

U.S. PATENT DOCUMENTS

| | | | |
|---|---|---|---|
| 1,598,962 | 9/1926 | Fisch | 52/467 X |
| 3,423,896 | 1/1969 | Widerby | 52/467 X |
| 4,104,839 | 8/1978 | Balzer et al. | 52/288 X |
| 4,430,833 | 2/1984 | Belzer et al. | 52/255 |
| 4,489,121 | 12/1984 | Luckanuck | 52/232 X |

FOREIGN PATENT DOCUMENTS

| | | | |
|---|---|---|---|
| 245619 | 6/1963 | Australia | 52/288 |

*Primary Examiner*—Alfred C. Perham

*Attorney, Agent, or Firm*—Schmidt, Johnson, Hovey & Williams

[57] ABSTRACT

A fire-rated, flush mounted corner guard is provided which serves to maintain continuous integrity in the fire rating of building walls notwithstanding the recessing thereof to accommodate a corner guard and consequent lessening of the amount of fire rock present at the corner. The corner guard preferably includes an upright, continuous, floor-to-ceiling, L-shaped in cross-section synthetic resin corner cover, means for resiliently mounting the cover within a corner recess substantially flush with the building walls, and insulating means within the corner recess beneath the cover. In this way the corner guard assembly provides a fire rating substantially equivalent to the fire rating of the walls. Preferably, the insulating means includes a heat-expandable continuous ceramic insulating sheet and steel protector disposed over the insulating material and beneath the cover and which overlaps the wall outermost surfaces adjacent the corner portion.

11 Claims, 3 Drawing Figures

FIRE-RATED FLUSH MOUNTED CORNER GUARD

BACKGROUND OF THE INVENTION

1. Field of the Invention

This invention relates to a fire-rated flush-mounted, corner guard of simple yet highly effective construction which has the advantage of providing an aesthetically pleasing flush mounted corner guard for an exposed corner in a building hallway or the like, while maintaining the fire rating integrity of the wall and corner. More particularly, it is concerned with a corner guard having a cover resiliently mounted to an inset corner portion, flush with the building walls, with insulating means disposed between the cover and the corner portion which provides a fire rating substantially equivalent to the fire rating of the adjacent walls.

2. Description of the Prior Art

State and local building codes almost universally require that the interior walls of buildings have a "fire rating". For example, the Uniform Building Code requires a two-hour fire rating for interior walls as determined by ASTM Test E-119. The two-hour standard requires that a wall exposed to a flame at 1800 degrees Farenheit for two hours not allow a temperature rise above ambient of more than 250 degrees Farenheit on the other side of the wall, and that upon conclusion of the two-hour firing, the flame-exposed wall portion not pass any water from a fire hose stream directed against the wall.

A two-hour fire rating for interior walls is typically achieved by constructing walls having two layers of ⅝" thick face-to-face sheet rock panels. These panels are also called fire rock panels.

Along with the required two-hour fire rating, it may also be desirable to install corner guards on exposed interior wall corners. This is especially true in buildings which are subject to extensive wheeled cart traffic, such as hospitals. Without corner guards, the corners quickly become chipped and damaged. This in turn requires frequent repair.

Flush mounted corner guards prevent corner damage and also present a pleasing appearance. A typical corner guard, such as that manufactured by Balco, Inc. of Wichita, Kan. incorporates an impact-resistant, textured thermoplastic corner guard cover retained to the corner of the wall by a recessed aluminum retainer anchored to a substratum of the wall. In some models, a continous shock-absorbing cushion may extend along the length of the retainer between it and the cover for resiliently absorbing blows of any vehicles which may run into the guard.

Flush installation of a corner guard requires the wall portion in the vicinity of the corner to be inset or recessed. This is usually achieved by removing the outer layer of fire rock at the vicinity of the corner (or by omitting this portion of the outer layer during construction). However, absence of the outer layer portion of the fire rock reduces or eliminates the fire rating of the wall below that required by applicable codes, i.e., the wall no longer has a two hour rating.

According, there is a decided need for a fire-rated corner guard which can be flush-mounted without reducing the fire rating of the adjoining walls in the vicinity of the corner.

SUMMARY OF THE INVENTION

The problems outlined above are solved by the fire-rated, flush-mountable corner guard in accordance with the present invention. That is to say, the corner guard hereof is specially designed for mounting along corners of building walls in order to maintain the required fire rated integrity of the corner while allowing a flush mounted configuration.

The corner guard of the invention is designed for mounting within an upright corner recess defined by adjoining walls which are relieved (typically by the absence of one layer of fine rock) at the corner region.

The cover assembly broadly includes a corner cover having a pair of surface stretches, means for mounting the cover within the corner recess in a flush relationship with the outermost surfaces of the building walls, and insulating means interposed within the corner recess and behind the corner cover. In this way the corner guard resists the effects of heat and enhances the fire rating of the overall wall construction. Indeed, the cover assembly hereof advantageously exhibits a fire rating substantially equivalent to the fire rating of the adjacent walls.

In particularly preferred forms, the insulating means includes a ceramic insulating material and a stainless steel metal protector which is disposed between the insulating material and the cover. Advantageously, the protector includes elongated, side marginal flanges disposed for overlapping engagement with the outermost surfaces of the walls adjacent the corner recess.

DESCRIPTION OF THE PREFERRED EMBODIMENT

Figure 1:
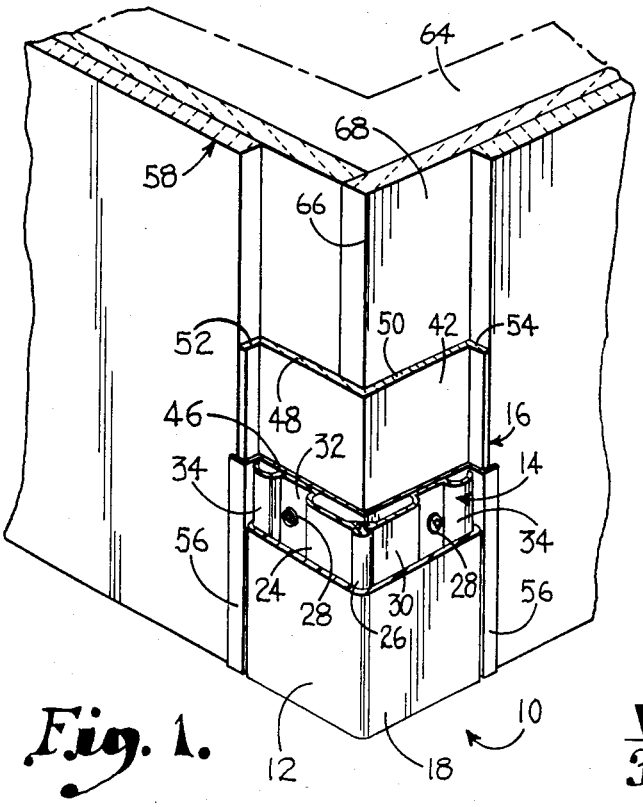
FIG. 1 is a perspective view of the corner guard of the invention mounted in a recessed corner, with parts removed to illustrate the internal construction of the guard assembly.
Figure 2:
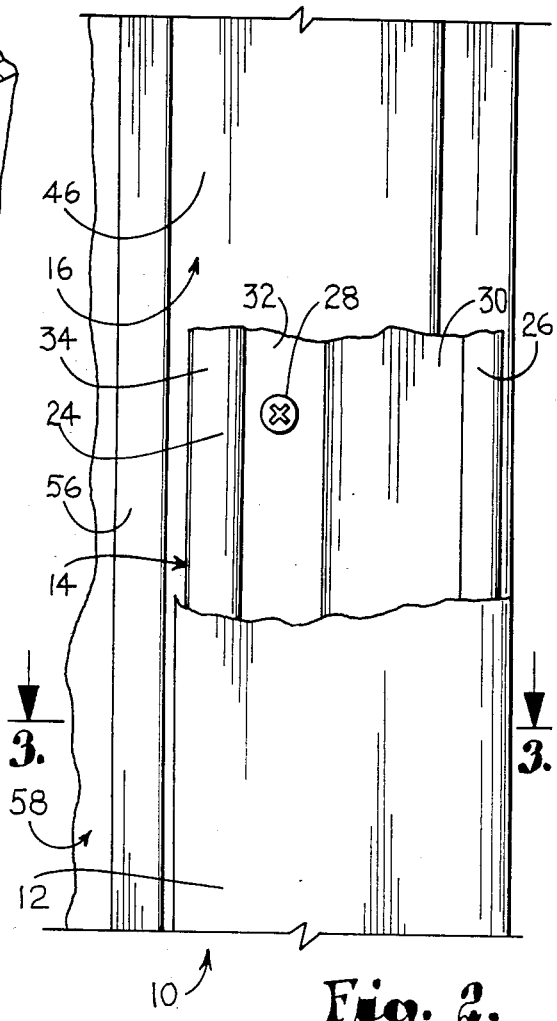
FIG. 2 is a fragmentary view with parts broken away for clarity of the corner guard mounted to an exposed interior wall corner.

Referring now to the drawings, corner guard 10 in accordance with the present invention broadly includes corner cover 12, mounting means 14, and insulating means 16. The overall guard assembly is designed to completely cover a corner guard defined by adjoining walls from floor to ceiling, while maintaining the fire rating of the walls.

Elongated, flexible, upright L-shaped corner cover 12 is preferably composed of a high impact resistant, flexible vinyl, synthetic resin material. Cover 12 is integrally formed and includes an L-shaped section 18, a pair of inwardly extending marginal retaining flanges 20 respectively at opposed sides of section 18, and a pair of inwardly extending retaining lips 22 respectively located at the inner edges of the flanges 20.

Mounting means 14 includes upright metallic retainer 24, resilient shock-absorbing cushion 26 and a plurality of fasteners 28 for securing the retainer 24 to a corner recess.

Elongated retainer 24 is preferably composed of extruded aluminum and is integrally formed to include L-shaped in cross-section corner portion 30, a pair of flat mounting stretches 32 respectively extending from opposed sides of corner portion 30, and a pair of clips 34 of semi-circular cross-section and respectively located at the outer edges of the mounting portions 32. As best viewed in FIG. 3, mounting portions 32 are offset inwardly from the respective legs making up corner portion 30. The exposed outermost edges of clips 34 respectively are located to engage and stop the lips 22, thereby removably retaining cover 12 to mounting means 14.

Elongated, upright rubber-like, resilient shock-absorbing cushion 26 includes a T-shaped connecting flange 36 received in a correspondingly shaped connecting slot 38 defined in the outer corner surface of portion 30. Cushion 26 also has a tubular cushioning rib 40, arcuate in cross-section, which extends outwardly from corner portion 30 being thereby disposed between mounting means 14 and cover 12 as shown.

Threaded fasteners 28 are received through a corresponding plurality of fastener holes (not shown) defined along the length of mounting portions 32.

Upright insulating means 16 includes thermal insulating material 42 having an attached alumnium foil backing 44, and metal protector 46. Insulating material 42 is preferably a ceramic-type insulating material well known to those skilled in the art of fire protection, which has the useful property of doubling its volume when exposed to heat, the usefulness of which will become apparent from later discussion herein.

Figure 3:
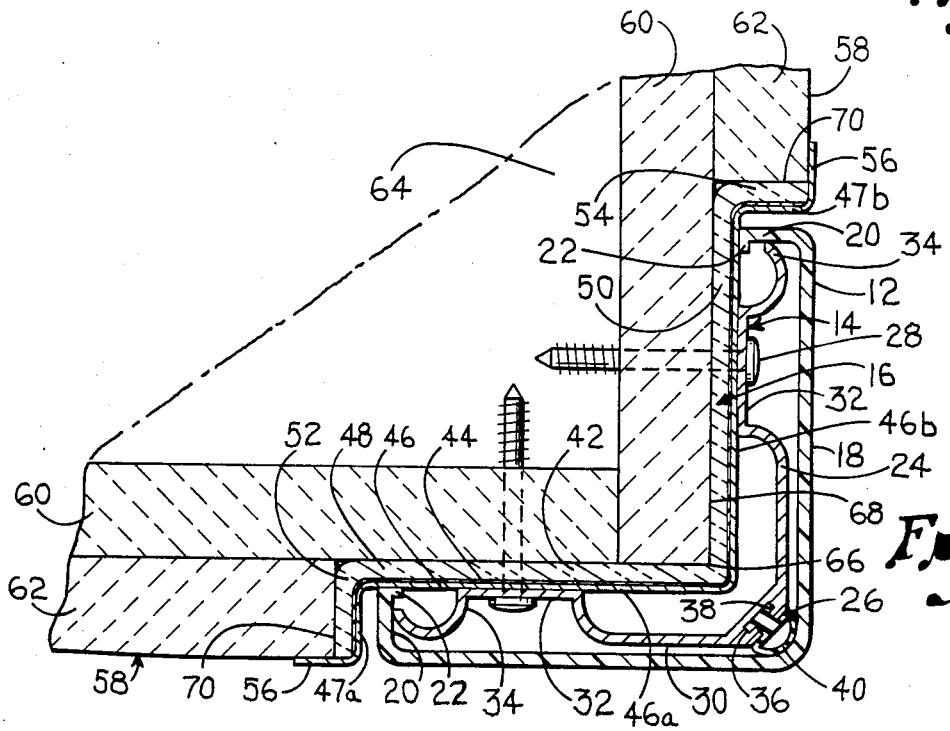
FIG. 3 is a sectional view along line 3—3 of FIG. 2.

With reference to FIG. 3, insulating material 42 presents an L-shaped cross-sectional configuration and has a pair of main legs 48, 50 and a pair of marginal, outwardly extending tabs 52 and 54 respectively disposed on the outer edges of the main insulating legs 48 and 50. Insulating material 42, as illustrated in FIG. 3 is composed of one single integral piece of insulating material. Those skilled in the art will appreciate, however, that for ease of construction and manufacture, the legs 48 and 50 could be separate pieces of insulating material forming an abutting joint at the juncture thereof.

Aluminum foil backing 44 is provided merely as an aid in the handling of insulating material 42 inasmuch as the material has a tendency to flake and crumble.

Upright metal protector 46 is preferably composed of stainless steel and is configured as shown in FIG. 3 to completely overlay insulating material 42 in generally close fitting engagement. That is to say, the material 42 is in engagement with the exposed surfaces of inner layer 60, whereas protector 46 is in face-to-face engagement with the surface of material 42 remote from layer 60. It is noteworthy also that protector 46 includes upright major legs or stretches **46*a*, 46*b*, together with outwardly extending ends 47*a*, 47*b* abutting the tabs 52, 54 as shown. Finally, the protector presents a pair of engagement flanges 56 extending along the outboard sides thereof on respective opposed sides of protector 46. A plurality of fastener holes (not shown) through the stretches 46*a*, 46*b*, are respectively aligned to receive fasteners 28 passing through retainer 24**.

With reference now to FIG. 3, a conventional interior building wall 58 is composed of inner layer 60 and outer layer 62 each formed of a $\frac{5}{8}$" thick sheet of conventional fire rock. Layers 60, 62 are nailed or otherwise fastened to building studs 64. In order to accommodate a corner guard, however, outer layer 62 is relieved during construction or otherwise removed in the vicinity of exposed corner 66, leaving only the adjoining portions of inner layer 60 to form corner 66. In this way, corner recess 68 is presented for receiving corner guard 10 with cover 12 flush with outermost surfaces of the layers 62.

Fasteners 28 are employed to mount corner guard 10 to recess 68 by extending through mounting portions 32, metal protector 46, foil backing 44, insulating material 42, inner layer 60, and into building stud 64. The inner surfaces of the flanges 56 of protector 46 engage the outermost surfaces of layer 60 as shown in FIG. 3 adjacent the recess 68. Insulating material 42 is thereby completely covered and retained between protector 46 and recess 68.

In the event of a fire equivalent to ASTM Test E-119, corner guard 10 is exposed to temperatures of 1800 degrees Farenheit for two hours. During this time cover 12 and retainer 24 will likely burn or melt away, exposing stainless steel metal protector 46 which can readily withstand these temperatures. Insulating material 42 and inner layer 60 cooperate to form a combined fire rating essentially equivalent to the fire rating of inner and outer layers 60, 62 adjacent corner guard 10. In this way, the fire rating integrity of the entire wall 58 is maintained, even though outer layer 62 is not present at the corner region. Protector 46 further prevents the passage of water from a fire hose through the wall at the end of two-hour fire exposure.

As illustrated in FIG. 3, a pair of regions 70 are formed between the butt ends of outer layer 62, and the adjacent ends **47*a*, 47*b* of protector 46. Insulating tabs 52, 54 generally fill such regions 70 to maintain fire rating integrity. During building construction, however, the regions 70 may end up larger than specified in which event insulating tabs 52, 54 may not completely fill the regions 70. This situation might lead to a break in the fire rating integrity because of a lack of insulating material. Ceramic insulating material 42, however, doubles in volume when exposed to heat (if not constrained), thereby completely filling the regions in the event of fire in order to maintain a continuous and unbroken fire rating. In this way, builders and inspectors can be assured that the required fire rating is maintained as long as flanges 56 overlap at least some portion of the outermost surfaces of layer 62 adjacent recess 68**.

Those skilled in the art will appreciate that the present invention contemplates many variations in the preferred embodiment herein described. For example, a wide variety of insulating materials are available other than ceramic insulating materials which would satisfy desired fire rating requirements. Additionally, an end wall in a building interior may present two corners adjacent to one another separated only by the thickness of the wall; the present invention also therefore contemplates and comprehends a C-shaped integral double corner guard rather than two separate L-shaped corner guards. Also, retainer 24 and metal protector 46 could be of integral construction if desired.

I claim:

1. A fire rated guard for covering a junction area presented by adjacent walls, said walls each having an outermost surface and being relieved in the vicinity of said juncture area for defining a recessed area presenting recess-defining wall surfaces for receiving said guard, said fire rated guard comprising:

a cover configured to substantially cover said recessed area;

means for mounting said cover in covering relationship to said recessed area;

heat insulating and protective means interposed within said recessed area and behind said cover for resisting the effects of heat and increasing the fire rating of said walls in the vicinity of said juncture area, said heat insulating and protective means comprising a thin metallic protector plate disposed in proximal, face-to-face relationship with said recess-defining wall surfaces for cooperatively defining between the recess-defining wall surfaces and said plate a continuous, thin, insulation-receiving channel, said protector plate being formed of metallic material capable of withstanding exposure to a flame of 1800° F. for two hours such that, after the two hour flame exposure, the protector plate will not pass water from a fire hose stream directed thereagainst, said insulating and protective means further comprising a thin sheet of thermal insulating material situated within said insulating-receiving channel and remote from said mounting means and cover, the combined thickness of said insulating material and plate being substantially less than the depth of said recessed area whereby said guard will essentially fit within the recessed area to give a smooth, aesthetic appearance to said juncture area.

2. The guard as set forth in claim 1, said protector including a pair of side marginal flanges respectively abutting an outermost wall surface adjacent said recess.

3. The guard as set forth in claim 1, said protector plate being separate from said mounting means.

4. The guard as set forth in claim 1, said insulating material including ceramic insulating material.

5. The corner guard as set forth in claim 1, said metal protector being composed of steel.

6. The guard as set forth in claim 1, said material being in face-to-face contact with the recess-defining surfaces of said adjoining walls, said protector being in covering contact with the face of said material remote from said recess-defining surfaces.

7. The guard as set forth in claim 1, said cover having a pair of stretches respectively flush and in alignment with a corresponding adjacent outermost wall surface.

8. A fire rated guard for covering a junction area presented by adjacent walls, said walls each having an outermost surface and being relieved in the vicinity of said juncture area for defining a recessed area presenting recess-defining wall surfaces for receiving said guard, said fire rated guard comprising:

a cover configured to substantially cover said recessed area;

means for mounting said cover in covering relationship to said recessed area;

heat insulating and protective means interposed within said recessed area and behind said cover for resisting the effects of heat and increasing the fire rating of said walls in the vicinity of said juncture area, said heat insulating and protective means comprising thermal insulating material and a metal protector disposed between said insulating material and said cover, said protector including a pair of side marginal flanges respectively abutting a corresponding outermost wall surface adjacent said recess.

9. The fire rated guard of claim 8, said thermal insulating material comprising a thin sheet of ceramic insulating material.

10. The fire rated guard of claim 8, said metal protector being formed of steel.

11. The fire rated guard of claim 8, said protector being disposed in proximal, slightly spaced apart, face-to-face relationship with the recess-defining wall surface of said adjacent walls, said insulating material being located between said recess-defining wall surfaces and said protector, with said protector being in covering contact with the face of said insulating material remote from said recess-defining wall surfaces.

* * * * *